United States Patent [19]

Walden

[11] Patent Number: 4,911,432

[45] Date of Patent: Mar. 27, 1990

[54] HIP MOUNTED EXERCISING DEVICE

[76] Inventor: Drue Walden, 411 McIntosh Dr., Waynesboro, Ga. 30830

[21] Appl. No.: 245,457

[22] Filed: Sep. 16, 1988

[51] Int. Cl.[4] ..... A63B 69/26

[52] U.S. Cl. ..... 272/119; 272/143; 273/DIG. 19

[58] Field of Search ..... 272/1 R, 128, 143, 119; 273/DIG. 19

[56] References Cited

U.S. PATENT DOCUMENTS

| | | | |
|---|---|---|---|
| 3,224,774 | 12/1965 | Klotz | 273/DIG. 19 |
| 3,342,482 | 9/1967 | Paolone | 273/DIG. 19 |
| 3,610,622 | 10/1971 | Haroski | 272/143 X |
| 3,774,910 | 11/1973 | Walker, Jr. | 273/DIG. 19 |
| 3,782,727 | 1/1974 | Chirnomas | 273/DIG. 19 |
| 3,863,924 | 2/1975 | Gagnon | 273/DIG. 19 |
| 4,121,822 | 10/1978 | DiSabatino | 273/DIG. 19 |
| 4,248,435 | 2/1981 | Barmore | 273/DIG. 19 |

*Primary Examiner*—Richard E. Chilcot, Jr.
*Attorney, Agent, or Firm*—James B. Middleton

[57] ABSTRACT

An exercising device can be used for fun and for aerobic exercise. A rebound board is placed against the pelvic area of a person, and a ball is tethered to the board by a stretchable tether. The person can somewhat bounce, bending and straightening the knees, with consequent movement of the hips causing the ball to bounce rhythmically on the rebound board. More or less energetic movement of the hips renders the exercise more or less strenuous, and weights can be held in the hands to increase the stress.

12 Claims, 1 Drawing Sheet

Fig_1
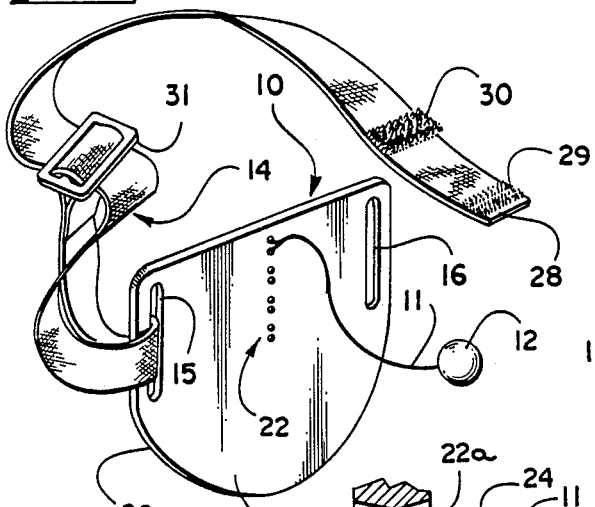
Fig_2
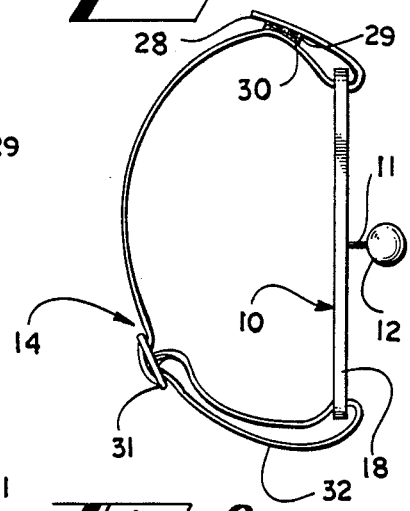
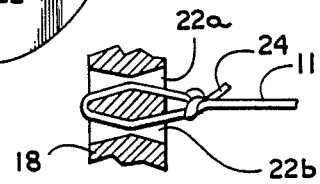
Fig_3
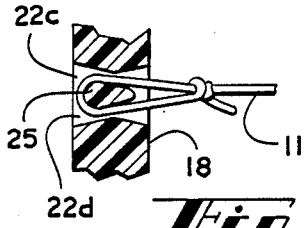
Fig_4
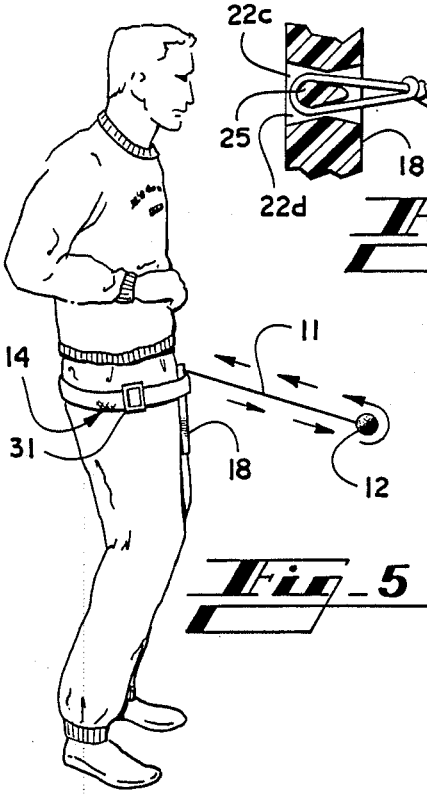
Fig_5
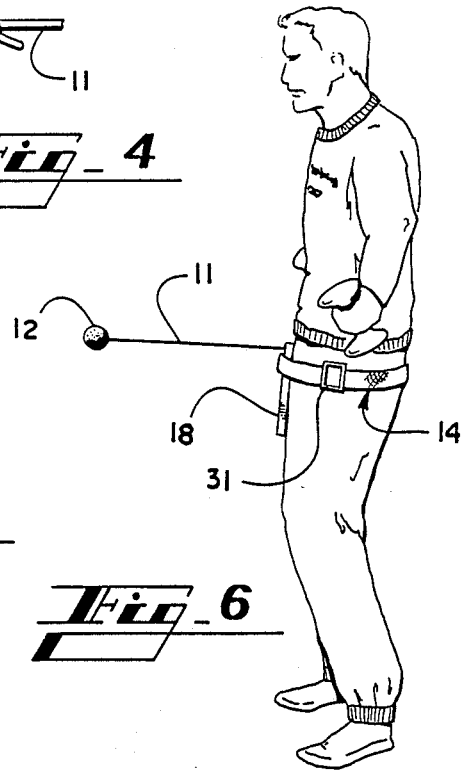
Fig_6

HIP MOUNTED EXERCISING DEVICE

INFORMATION DISCLOSURE STATEMENT

It has become common to provide an exercising device that is somewhat enjoyable to use while yielding beneficial results in body conditioning, muscle tone and the like. While participation in many sports might provide needed exercise, there is a constant search for some method and apparatus that will allow an individual to exercise alone, and to select the pace and strenousness of the exercise. Though many routines, or exercises, have been devised to work certain muscles and joints, these routines are generally rather boring to the individual, and lack the skill and feelings of personal achievement that will maintain a person's interest.

SUMMARY OF THE INVENTION

This invention relates generally to a method and apparatus for exercising, and is more particularly concerned with an exercising device in the form of a game of skill for achieving both exercise and feelings of personal achievement.

The present invention provides a hip-mounted rebound board carrying an elastic ball on a stretchable tether. Appropriate motion of the rebound board will cause the elastic ball to bounce on the board, extend therefrom, and be returned to the board by the stretchable tether. Both skill and uniform rhythm are therefore required to maintain the repetitive bouncing of the ball on the rebound board.

The ball can be varied in its degree of elasticity, and its size and weight. The tether can also be varied in its strength to be matched to the weight of the ball and the periodicity of the rebounding. In using the apparatus of the present invention, a person can put a small amount of energy into the rebound board to achieve a gentle, rhythmic exercise. If desired, a large amount of energy can be put into the rebound board to achieve a more vigorous exercise; and, additional weight can be held in the hands for greater muscular stress in other parts of the body.

BRIEF DESCRIPTION OF THE DRAWINGS

These and other features and advantages of the present invention will become apparent from consideration of the following specification when taken in conjunction with the accompanying drawings in which:

FIG. 1 is a perspective view showing an exercising device made in accordance with the present invention;

FIG. 2 is a top plan view of the device illustrated in FIG. 1;

FIG. 3 is an enlarged, fragmentary cross-sectional view taken substantially along the line 3—3 in FIG. 1;

FIG. 4 is a view similar to FIG. 3, showing a modified form of tether attaching means;

FIG. 5 is an illustration showing the device of FIG. 1 mounted on a person and illustrating a mild form of exercise; and, FIG. 6 is a view similar to FIG. 5 but showing a more strenuous form of exercise.

DETAILED DESCRIPTION OF THE EMBODIMENT

Referring now more particularly to the drawings, and to that embodiment of the invention here presented by way of illustration, the exercise device shown in FIG. 1 of the drawings includes a rebound board generally designated at 10 having a tether 11 fixed thereto, the tether 11 carrying an elastic ball 12. To mount the rebound board 10 on a person, there is a strap generally designated at 14, the strap being attachable to the rebound board 10 through elongated belt slots 15 and 16.

Looking at FIGS. 1 and 2 for a more detailed understanding of the device, it will be noted that the rebound board 10 is generally straight so that the outer surface 18 provides a flat, rebound surface for the ball 12. While the shape of the rebound board 10 may be varied somewhat, the board 10 is here shown as having a generally straight, upper edge 19, and a substantially semi-elliptical configuration. The semi-eliptical configuration for the rebound board 10 is desirable in order to provide a relatively large expanse in the center for rebounding of the ball 12. Yet, at the lateral edges 20 and 21, the rebound board 10 curves inwardly to allow some freedom of movement of the person's legs.

Since the ball 12 is intended to bounce from the rebound surface 18 of the rebound board 10, it will be understood that deviations from the flat surface will cause erratic bouncing of the ball 12. Thus, the means for attaching the tether 11 to the rebound board 10 is preferably such as not to cause such erratic bouncing. As here shown, the rebound board 10 is provided with a plurality of openings 22 therethrough so the tether 11 can be tied through one or more of the openings.

The rebound board 10 may conveniently be made of wood or the like. For a board 10 made of wood, the holes 22 may be provided by drilling, and this arrangement is shown in more detail in FIG. 3 of the drawings. In FIG. 3 there are two holes designated at **22*a* and 22*b*, the holes 22*a* and 22*b* corresponding to one of the pairs of holes illustrated in FIG. 1 of the drawings. Of course a simple pair of drilled holes will suffice for securing the tether 11, but the holes 22*a* and 22*b* are shown somewhat tapered at each side of the rebound board 10. Those skilled in the art will understand that a hole can be drilled, then a tapered bit can be inserted into the hole to provide the tapered extremity. The tapered bit can similarly be applied to the back of the rebound board 10 so the holes 22*a* and 22*b* are flared at both back and front. This provides greater ease in threading the strand of the tether 11 through the rebound board 10. Once the tether 11 is threaded through the holes 22*a* and 22*b*, the strand is knotted as at 24**, or otherwise secured to itself.

The rebound board 10 may also be made of plastic or other moldable materials. For a moldable board, the holes 22 may be molded in the rebound board at the time the board itself is molded. Such an arrangement is illustrated in FIG. 4 of the drawings where it will be seen that there is an opening **22*c* and an opening 22*d*. The two openings 22*c* and 22*d* are substantially connected at the front and rear of the rebound board 10, but there is a central portion 25 to hold the tether. Therefore, the tether 11 can be passed through the hole 22*c*, then through the hole 22*d***, and the material can be fixed to itself, again by a knot or the like.

In order to hold the rebound board in position on a person's hips, the strap 14 is removable and adjustable. The strap 14 includes a free end 28, the free end 28 carrying strips of hook and teasel material designated at 29 and 30 respectively. Thus, the end 28 can be passed through the slot 16 in the rebound board 10, and the hook material 29 can be placed against the teasel material 30 for providing a loop as is illustrated in FIG. 2 of the drawings.

The opposite end of the belt 14 carries a buckle 31. From the axle of the buckle 31, the strap 14 is passed through the slot 15, then back through the buckle 31, and to the free end 28. Looking again at FIG. 2 of the drawings, it will be seen that the buckle 31 can be moved along the strap 14 to increase or decrease the size of the loop 32 which passes through the slot 15. Such motion will lengthen or shorten the strap as a whole to adjust the strap to the individual.

With the above description in mind, the method for using the exercising device should be understandable. The following description will consider a relatively mild form of exercise and a more strenuous form of exercise using the device, but those skilled in the art will easily devise additional methods utilizing the device of the present invention, and the precise methods are not intended to limit the scope of the present invention.

Looking at FIG. 5 of the drawings, it will be seen that the exercise device is mounted at the front of the person, the rebound board 10 being generally in front of the pelvic area. The strap 14 extends around the hips of the person to hold the rebound board 10 in position. Since the slots 15 and 16 are elongated beyond the width of the belt 14, it will be noted that the rebound board 10 can be moved up or down to some extent without moving the belt 14 with respect to the person. This adjustment renders proper positioning of the rebound board 10 quite simple to prevent repeated adjustments of the strap 14. It should also be understood that the strap 14 is preferably elastic material which will adequately retain the set position of the rebound board 10.

With the exercising device in place as shown in FIG. 5, the person may hold the ball 12 by hand to position the ball for starting. The person will then bend at the knees, perhaps bending the torso somewhat rearwardly as a counter-balance, and causing the hip area to move forward. At this forward movement, the ball 12 is somewhat thrown against the rebound board 10 so the ball 12 is caused to bounce off the rebound board 10. Since the ball 12 is held by the stretchable tether 11, the ball will be pulled back towards the rebound board 10 for a subsequent bounce. At the time for each bounce, the exerciser will bend at the knees and thrust the hips slightly forward as described above to provide the necessary energy for the ball 12 to bounce and stretch the tether 11.

With the exercise described, it will be understood that there is a very gentle bouncing utilizing the knees, and slight motion of the arms and torso to counter-balance the action of the hips. This action must be maintained in a regular rhythm because of the stretchable tether and the elasticity of the ball 12 so that one is forced into a highly rhythmic exercise. The exercise can be aerobic because there is distinct body motion, and the motion must be rhythmic. Sustained for a sufficient period of time, the exercise meets the requirement of aerobic exercise. Further, the gentle method described above can be used by beginners so the person will not be over-taxed, and the more strenuous methods described below can be used as the person becomes better conditioned.

Looking then at FIG. 6 of the drawings, it will be understood that the exercising device is mounted in the same way on the person exercising, and the difference is in the energy exerted by the exerciser. As is shown in FIG. 6, the exerciser can thrust the hips forwardly more forcefully to cause the ball 12 to move farther out, stretching the tether 11 to a greater extent. This greater force must be counter-balanced by greater force so that the upper torso is moved through a greater distance and stressed to a greater extent. Also, as is shown in FIG. 6, the more advanced exerciser may wish to utilize dumbells or other weights in the hands. Again, the additional weight will create additional stress on the body muscles for a move vigorous exercise.

It will be realized by those skilled in the art that the motion of the ball 12 is a function of several variables. The ball 12 may be highly elastic (very hard) or very inelastic (very soft), and of course the higher the elasticity of the ball 12 the farther the ball will tend to rebound from the rebound board 10. Also, the strength and resilience of the tether 11 is an important feature. A very easily stretchable tether 11 will allow a ball to rebound farther, and will pull the ball towards the rebound board 10 with less force. The weight of the ball 12 is also important. The strength of the tether 11 and the elasticity of the ball 12 are determinative of the forces acting on the ball, while the weight of the ball in relation to the forces determines the distance the ball will travel. With these many variables, it will be understood that a ball 12 and a tether 11 can be selected to achieve the desired rhythm and degree of exercise in using the device. A very heavy ball 12 with a strong tether 11 will allow the exerciser to exert a large amount of energy in bouncing the ball. The opposite extreme is to utilize a rather weak and easily stretchable tether 11 with a relatively light weight ball 12. This will give a long period to the motion of the ball 12 and require very little energy input.

It will be understood by those skilled in the art that the exercise device of the present invention is readily adaptable to many different individual users. The tether 11 can be attached to the rebound board 10 at many different positions so the ball 12 will rebound from the rebound board 10 for any selected ball and tether and any selected degree of exercise. The adjustable strap 14 and the vertically adjustable rebound board 10 allow complete freedom in placement of the rebound board 10 with respect to the exerciser while allowing maximum comfort and freedom of motion to the exerciser.

It will therefore be understood by those skilled in the art that the particular embodiment of the invention here presented is by way of illustration only, and is meant to be in no way restrictive; therefore, numerous changes and modifications may be made, and the full use of equivalents resorted to, without departing from the spirit or scope of the invention as outlined in the appended claims.

I claim:

1. An exercising device for providing aerobic exercise for a person, said exercise device comprising a rebound board receivable in front of the pelvic area of the person and strap means for holding said rebound board against the pelvic area, said rebound board defining vertically elongate slots for receiving said strap means therethrough, said strap means having sufficient length for passing around the hips of the person, said rebound board including a flat forwardly facing surface as a rebound surface, a ball constructed for elastically colliding with and rebounding from said rebound surface, and a stretchable tether, one end of said stretchable tether being fixed to said rebound board and the opposite end of said stretchable tether being fixed to said ball.

2. An exercise device as claimed in claim 1, said one end of said tether being fixed to said rebound board generally along the vertical centerline thereof.

3. An exercise device as claimed in claim 1, said rebound surface having a configuration that is generally semi-elliptical, the major axis lying along said vertical centerline.

4. An exercise device as claimed in claim 3, and further including a plurality of means for fixing said one end of said tether to said rebound board, said plurality of means being distributed along said vertical centerline.

5. An exercise device as claimed in claim 4, said means for fixing one end of said tether to said rebound board being co-planar with said flat rebound surface.

6. An exercise device as claimed in claim 5, said means for fixing one end of said tether to said rebound board including at least one hole defined through said rebound board and said rebound surface for receiving said tether therethrough.

7. An exercise device as claimed in claim 1, said strap means having a width less than the length of said elongate slots so that said rebound board can be vertically adjusted with respect to said strap means.

8. An exercise device as claimed in claim 7, and further including adjusting means for varying the effective length of said strap means.

9. A method whereby a person exercises aerobically, said method including the steps of placing a rebound board in front of the pelvic area of said person and tethering a ball thereto with a stretchable tether, bending the knees and simultaneously moving the hips forwardly for bouncing said ball off said rebound board and projecting said ball forwardly, then straightening the knees and simultaneously moving the hips rearwardly for causing said stretchable tether to urge said ball towards said rebound board, and repeating the steps including the moving of the hips forwardly and moving of the hips rearwardly, said steps being repeated rhythmically to cause continual bouncing of said ball off said rebound board.

10. A method as claimed in claim 9, and further including the step of moving the upper torso of said person rearwardly during said step of moving the hips forwardly for maintaining said person's balance.

11. A method as claimed in claim 10, and including the additional steps of gradually increasing the force with which the hips are moved forwardly as said person's body becomes conditioned through exercise.

12. A method as claimed in claim 11, and including the steps of placing weights in said person's hands for increasing the stress on the upper torso during exercise.

* * * * *